United States Patent [19]

Neat

[11] Patent Number: 4,548,332

[45] Date of Patent: Oct. 22, 1985

[54] TAMPERPROOF PLASTIC CONTAINER

[76] Inventor: Benjamin C. Neat, 11201 Easum Rd., Jefferson Town, Ky. 40299

[21] Appl. No.: 688,002

[22] Filed: Dec. 31, 1984

[51] Int. Cl.[4] ..... B65D 41/34

[52] U.S. Cl. ..... 220/268; 215/252; 215/306; 220/375

[58] Field of Search ..... 220/265, 268, 375; 215/250, 252, 306

[56] References Cited

U.S. PATENT DOCUMENTS

| | | | |
|---|---|---|---|
| 3,874,570 | 4/1975 | Katzman et al. | 220/375 X |
| 4,197,955 | 4/1980 | Luenser | 215/252 |
| 4,320,853 | 3/1982 | Moore | 220/375 |
| 4,453,647 | 6/1984 | Neat | 220/288 |

*Primary Examiner*—Donald F. Norton

*Attorney, Agent, or Firm*—Brooks & Kushman

[57] ABSTRACT

A container (10) is disclosed as including a receptacle (12), a cover (14), and a tether (16) that are molded from plastic unitary with each other with the receptacle and cover connected by the tether. Downward cover movement over the receptacle provides a snap action engagement of locking surfaces on mating helical threads (30) and (32) of the receptacle and cover in order to prevent opening movement of the cover without unthreading rotation. The tether (16) has a length that is sufficiently long to permit the initial cover closing and sufficiently short to limit unthreading rotation of the closed cover for opening with the tether intact. Tether (16) is frangible by either cutting with a knife or scissors, etc. or by breaking upon the application of unthreading cover rotation to thereby provide a visual indication of the cover opening in order to render the container tamperproof.

10 Claims, 8 Drawing Figures

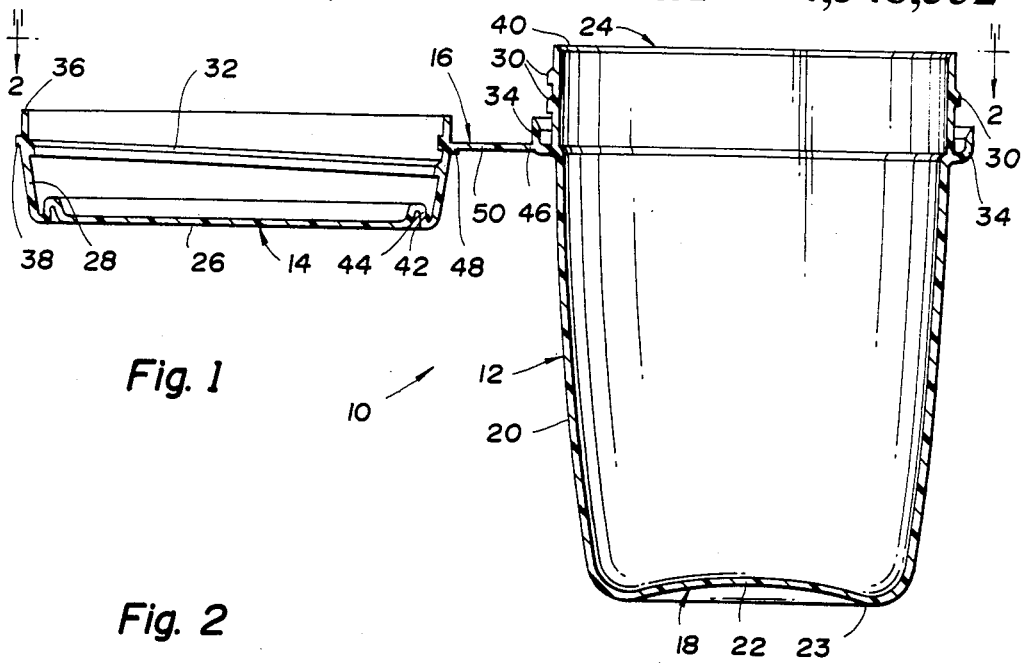
Fig. 1
Fig. 2
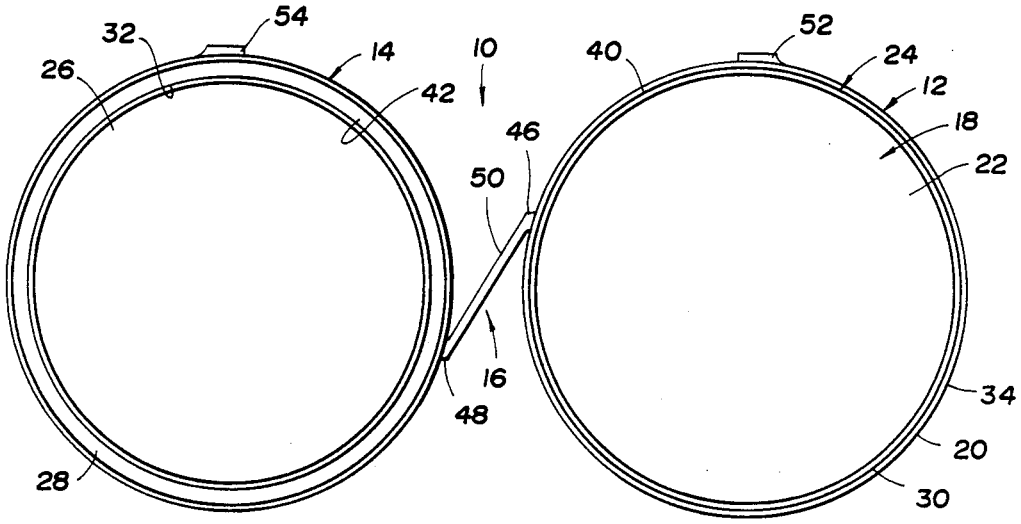
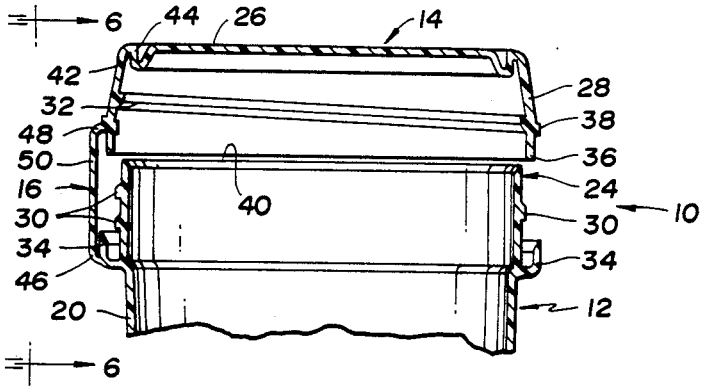
Fig. 3

TAMPERPROOF PLASTIC CONTAINER

TECHNICAL FIELD

This invention relates to a plastic container that has a tamperproof construction and thus has particular utility for packaging food, pharmaceuticals and the like, but which may also be utilized to hold other goods such as paint, varnish, and stain, etc. where it is likewise desirable to know whether the container has been initially opened.

BACKGROUND ART

Prior art plastic containers have included a unitary receptacle and a unitary cover that are secured to each other to close the container. Securement constructions previously utilized to securely hold the cover on the receptacle have not permitted easy opening and closing while still maintaining the cover securely closed on the receptacle. Also, there has not been any prior tamperproof design constructed as an integral part of a plastic container which has received any significant commercial acceptance.

Paint, varnish, stain and the like are conventionally sold at the retail level in metal cans which have an upper edge with a groove in which an annular edge of a metal cover is secured by a press fit. Opening of the cover is performed by prying the cover edge upwardly out of engagement with the can edge so that the stored contents can be used. Such metal cans are conventionally made from tin plated steel which has become more and more expensive in the recent past. Also, the ever increasing use of water-based latex paint with steel cans has necessitated the use of a special coating on the interior of the can in order to prevent the water from causing corrosion as the paint is stored. Another problem with metal paint cans is that they tend to dent when struck or dropped.

One prior attempt at making paint cans from other than metal utilized injection or blow molding of polypropylene pastic in order to overcome the corrosion problem when water-based latex paints are stored. This can require a molded bead on the inner surface at the upper end of the can in order to secure an associated cover with the required strength necessary to pass drop tests paint cans are subjected to before being accepted commercially by paint manufacturers.

U.S. Pat. Nos. 3,998,355 and 4,126,246 disclose plastic lids and pails which are secured to each other by engagement threads each of which extends about one-quarter of the circumference of the lid or pail. The size of the pails disclosed is relatively large, on the order of that required to hold five gallons of liquid or so. To date, this type of container has not found any widespread commerical acceptance as a paint container in the retail market. This lack of acceptance is probably a result of the fact that the pail wall thickness and cover wall thickness necessary to maintain engagement of the threads is so great as to make the construction impractical for paint containers which are normally sold at the retail level in a one gallon size or smaller. Also, the cover can only be secured to the pail by threading due to the cover, receptacle and thread construction involved.

U.S. Pat. Nos. 4,245,753 and 4,245,754 disclose plastic containers for paint wherein segmented buttress retainers secure a cover to a receptacle for storage while permitting removal of the cover upon rotation and subsequent upward movement. With this type of construction, the locations between the buttress retainers result in a spaced relationship between a side wall of the receptacle and an annular lip of the cover on which the segmented buttress retainers are supported. Such spacing between the receptacle side wall and the cover lip allows deflection therebetween in a manner that can disengage the buttress retainers such that opening of the cover can result in certain instances when the container is dropped.

My prior U.S. Pat. No. 4,453,647 discloses an improved plastic container having a receptacle and a cover which can be securely attached to each other by either threading rotation of the cover or downward cover movement onto the receptacle. The cover of this container can also be easily detached from the receptacle by unthreading rotation of the cover with respect to the receptacle. Such secure attachment of the cover to the receptacle is provided by at least one retainer on either the receptacle or the cover and is preferably provided by a retainer on both the receptacle and the cover. Each retainer has an annular shape and opens vertically, with the retainer of the receptacle opening upwardly, and with the retainer of the cover opening downwardly. Upon closing of the cover, the retainer of the receptacle receives the lower round edge of an annular lip on the cover and the retainer of the cover receives a round upper edge of the receptacle side wall to thereby maintain engagement of helical threads on the cover lip and the receptacle side wall. While this container construction securely holds the cover closed on the receptacle, there is no provision to prevent tampering of the closed container after filling with whatever goods are to be held by the container.

DISCLOSURE OF INVENTION

An object of the present invention is to provide an improved plastic container having a receptacle and a cover which can be securely attached to each other with a tamperproof construction that provides the container with particular utility for packaging food, pharmaceuticals and the like while also having use in holding other goods such as paint, varnish, and stain as well as anything else for which it is desirable to know whether the container has been initially opened.

In carrying out the above object, the container includes a receptacle, a cover, and a tether that are molded from plastic unitary with each other with the receptacle and cover connected by the tether. The receptacle of the container has a lower closed end and also has a round upper end that opens upwardly. The cover of the container includes an upper wall and an annular lip that extends downwardly from the upper wall. Mating helical threads are provided on the upper end of the receptacle and the annular lip of the cover. These threads have slide surfaces that are slidably engaged with each other by an initial downward movement of the cover over the receptacle. The threads also have locking surfaces that are engaged by each other by snap action upon continued downward cover movement to secure the cover in a closed position and prevent upward opening movement thereof without unthreading rotation of the cover with respect to the receptacle. In constructing the container, the tether is provided with a length that is sufficiently long to permit the initial cover closing and sufficiently short to limit unthreading rotation of the closed cover in order to prevent opening thereof with the tether intact connecting the receptacle and the cover. The construction of the tether is frangible to permit unthreading rotation of the cover for opening while also providing a visual indication of such opening to thereby render the container tamperproof.

In the preferred construction of the container constructed in accordance with the invention, the round upper end of the receptacle includes a retainer that prevent separating horizontal movement between the helical threads with the cover closed to thereby assist in the prevention of opening of the container cover with the tether intact. The round upper end of the receptacle also preferably includes a seal and the cover has a seal surface that engages the receptacle seal with the cover closed to seal the container. The preferred construction of the cover also includes a retainer that engages the upper end of the receptacle adjacent the seal and assists in preventing horizontal separating movement between the helical threads with the cover closed to thereby prevent opening of the container cover with the tether intact. The locking surfaces of the helical threads are preferably inclined to secure the helical threads against separating movement in cooperation with the retainer securement.

In the preferred construction, the tether has an elongated shape whose cross section may be a thin band, round, oval, square or any other suitable configuration. Upon opening, the elongated tether may either fracture by the opening rotational force imparted to the cover or may require cutting by a knife or scissors depending upon the plastic utilized and the size and shape of the tether cross section. The first end of the elongated tether is preferably integrally connected to the receptacle at its upper end, and the second end of elongated tether is preferably integrally connected to the cover at its annular lip.

The length of the elongated tether is most preferably short enough to require that the ends thereof be circumferentially aligned with respect to the container to permit the cover positioning over the receptacle for the downward closing movement with the tether intact. Also, the helical threads on the upper end of the receptacle and the annular lip of the cover are positioned such that, during downward closing movement, the cover must be rotated in an unthreading direction with respect to the receptacle to provide the snap action engagement of the locking surfaces that secures the cover closed. The extent of the cover unthreading movement during closing is of an extent that makes the tether taut to thereby prevent partial opening rotation of the cover with the tether intact. As such, tampering with the container is prevented.

To assist in opening the closed cover, the receptacle and the annular lip of the cover are preferably provided with opening assist lugs that are positioned adjacent each other in the closed cover position. These opening assist lugs permit a pry to be utilized to rotate the cover in an unthreading direction with respect to the receptacle for opening and may assist in the intial fracturing of the tether during such opening.

The objects, features, and advantages of the present invention are readily apparent from the following detailed description of the best mode for carrying out the invention when taken in connection with the accompanying drawings.

BRIEF DESCRIPTION OF DRAWINGS

FIG. 1 is an elevation view taken in section through a container which includes receptacle, a cover, and a tether constructed in accordance with the present invention to provide tamperproof closing;

FIG. 2 is a top plan view of the container taken along the direction of line 2—2 in FIG. 1;

FIG. 3 is a partial sectional view taken through the container in the same direction as FIG. 1 but showing the cover positioned over the receptacle in preparation for downward closing movement;

BEST MODE FOR CARRYING OUT THE INVENTION

Figure 4:
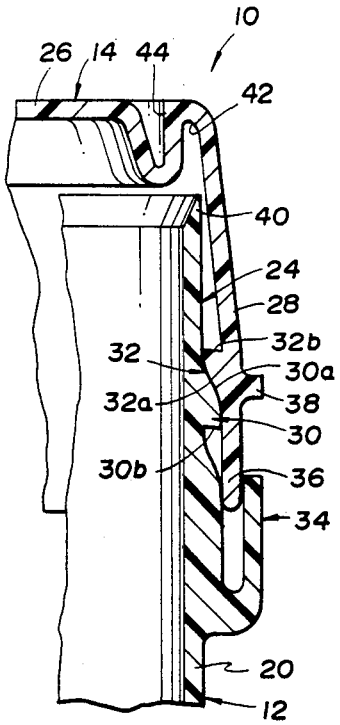
FIG. 4 is an enlarged, partial sectional view of the container after an initial downard movement that engages slide surfaces on helical threads of an upper end of the receptacle and a downwardly projecting annular lip of the cover.

With reference to FIGS. 1 and 2 of the drawings, a container constructed in accordance with the present invention is generally indicated by 10 and includes a receptacle 12, a cover 14, and a tether 16 that are molded from plastic unitary with each other with the receptacle and cover connected by the tether. Any suitable semirigid plastic is preferably utilized such as high density polyethylene, polypropylene, or polyethylene terephthalate, etc. Receptacle 12 has a lower closed end 18 that is cooperatively defined by a lower end of a receptacle side wall 20 and a bottom wall 22 which is illustrated as having a slightly upwardly projecting curved shape so as to provide an annular lower support surface 23 for the receptacle. Receptacle 12 also has a round upper end 24 that is defined by an upper end of the side wall 20 and opens upwardly with a wide mouth construction of the maximum diameter of the receptacle. As illustrated by FIG. 3, the cover 14 in its normal use orientation includes an upper wall 26 and also includes an annular lip 28 that extends downwardly from the upper wall at its outer periphery.

Figure 5:
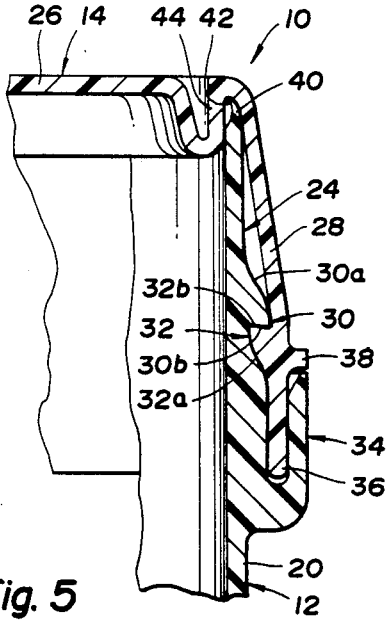
FIG. 5 is a view similar to FIG. 4 after the cover has been moved to a fully closed position where locking surfaces of the threads are engaged by a snap action.

As best illustrated in FIGS. 4 and 5, mating helical threads 30 and 32 are provided on the upper receptacle end 24 and the annular lip 28 of the cover, respectively. These helical threads 30 and 32 have associated slide surfaces **30*a* and 32*a* that are slidably engaged with each other as illustrated in FIG. 4 by an intial downward movement of the cover over the receptacle. Helical threads 30 and 32 also have associated locking surfaces 30*b* and 32*b*** that are engaged with each other as illustrated in FIG. 5 by a snap action upon continued downward cover movement. This snap action takes place as the upper end of the receptacle side wall 20 and the annular cover lip 28 flex to permit the downward cover movement from the position of FIG. 4 to the position of FIG. 5 as the cover thread 32 moves downwardly below the receptacle thread 30. Engagement of the locking surfaces 30*b* and 32*b* as illustrated in FIG. 5 secures the cover 14 in a closed position on the receptacle 12 and prevents upward opening movement thereof without unthreading rotation of the cover with respect to the receptacle.

Figure 8:
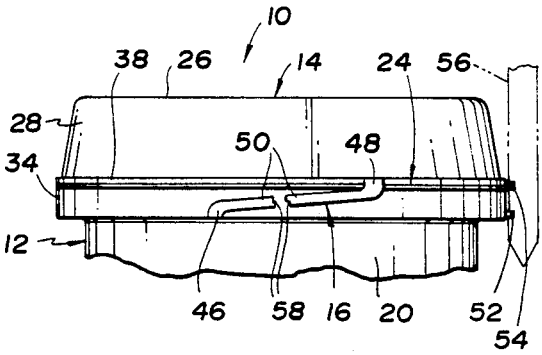
FIG. 8 is a partial elevation view taken in the same direction as FIG. 6 and illustrates the fractured condition of the tether upon the initial unthreading movement of the cover for opening.

As illustrated in FIG. 3, the tether 16 has a length that is sufficiently long to permit the cover 14 to be positioned over the receptacle 12 for the initial cover closing. Tether 16 also has a length that is sufficiently short to limit threading rotation of the closed cover in order to prevent opening thereof with the tether intact connecting the receptacle and the cover. Tether 16 is frangible by cutting with a knife or scissors or by breaking as a result of unthreading rotational force applied to the cover. Such fracturing of the tether 16 as illustrated in FIG. 8 permits unthreading rotation of the cover 14 for opening while also providing a visual indication of the opening to thereby render the container tamperproof.

The tamperproof feature provided by the unitary receptacle 12, cover 14, and tether 16 provides the container 10 with particular utility when utilized to package food, pharmaceuticals and the like. In addition, other goods, such as paint, varnish, and stain, etc. can also be packaged by the container to advantageously provide an indication of whether the container has been intially opened. This allows a store owner to make a determination whether a retail customer has returned the container unopened such that an exchange or refund should be permitted.

As best illustrated in FIGS. 3, 4, and 5, the preferred construction of the container 10 also has the round upper end 24 of the receptacle provided with a retainer 34 on the outer surface of the receptacle side wall 20. This retainer 34 receives the round lower edge 36 of the annular cover lip 28 in the closed position of the cover illustrated by FIG. 5. After the flexing of the receptacle side wall 20 and the cover lip 28 to provide the snap action closing previously described, the retainer 34 assists in prevention of separating horizontal movement between the helical threads 30 and 32 to thereby prevent opening of the container cover 14 with the tether intact. An annular rib 38 of the cover lip 28 is located just above the retainer 34 in the closed cover position and inhibits prying or other attempted tampering with the container. It should also be noted that other retainer constructions can be utilized such as illustrated in my aforementioned U.S. Pat. No. 4,453,647, the entire disclosure of which is hereby incorporated by reference.

As best illustrated in FIG. 4, the round upper end 24 of the receptacle includes a seal 40 that is preferably provided with a tapered configuration inclined upwardly in an outward direction. Cover 14 has an annular seal surface 42 that engages the receptacle seal 40 to seal the container as the cover is moved to the closed position illustrated in FIG. 5. The cover 14 also preferably includes a retainer 44 at the periphery of its upper wall 26 from which the annular cover lip 28 projects downwardly. This cover retainer 44 engages the upper end of the receptacle side wall 20 just below the seal 40 as illustrated in FIG. 5 to assist in the prevention of separating horizontal movement between the helical threads 30 and 32 with the cover closed.

Receptacle retainer 34 and cover retainer 44 cooperate as described above to maintain the helical thread engagement and thereby prevent opening of the cover with the tether intact. Locking surfaces 30*b* and 32*b* of the helical threads are preferably inclined in a reverse direction that secures the helical threads against separating movement in cooperation with the retainer securement. It will be noted that the lower edge 36 of the cover lip 28 has a slight spacing from the lower trough defined by the receptacle retainer 34 in order to intially permit the downward cover movement to a slightly greater extent than that shown as the inclined locking surfaces are moved past each other for the snap action engagement upon closing. Seal 40 also flexes to a slightly greater extent than that shown by the initial downward cover movement as the cover seal surface 42 initially moves downwardly to permit the inclined locking surfaces 30*b* and 32*b* of the threads to move past each other for the snap action engagement as previously described. Other interlocking configurations of the threads can also be used, such as the hook shape shown by my previously mentioned U.S. Pat. No. 4,453,647 which has been incorporated herein by reference. However, the inclined locking surfaces of the threads are the preferred construction.

As illustrated in FIGS. 1 and 2, tether 16 has an elongated shape whose length is much greater than any of its cross-sectional dimensions so as to be flexible in all directions like a cord. A first end 46 of tether 16 is integrally connected to the receptacle 12 and a second end 48 thereof is integrally connected to the cover 14. An intermediate portion 50 of the tether 16 has an elongated shape interconnecting the first and second ends 46 and 48 and may have any of the cross sections previously described. In the preferred construction illustrated, the first end 46 of the elongated tether 16 is integrally connected to the upper end 24 of the receptacle 12 at its retainer 34 previously described. Also, the second end 48 of the elongated tether 16 is integrally connected to the cover 14 at the outer surface of its annular lip 28.

Best results are achieved when the length of the tether 16 is short enough to require that the ends 46 and 48 thereof be circumferentially aligned with respect to the container as illustrated in FIG. 3 in order to permit the cover 14 to be positioned over the receptacle 12 for downward closing movement with the tether intact. Upon initial downward movement of the cover 14 for closing, the tether 16 begins to slacken. However, the helical threads 30 and 32 on the upper end 24 of the receptacle and on the annular lip 28 of the cover are positioned such that the cover during the downward closing movement must be rotated in an unthreading direction with respect to the receptacle to provide the snap action engagement of the thread locking surfaces that secures the cover closed. If such unthreading rotation of the cover is not performed during the downward closing movement, the slide surfaces 30*a* and 32*a* of the threads will remain in engagement with each other without permitting the snap action closing that engages the thread locking surfaces 30*b* and 32*b*. The extent of the cover unthreading movement during closing is of an extent that makes the tether 16 taut as illustrated in FIG. 6 to thereby prevent partial opening rotation of the cover with the tether intact.

Figure 6:
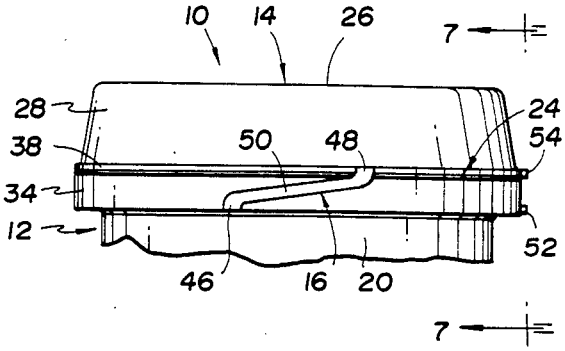
FIG. 6 is a partial elevation view of the container taken along the direction of line 6—6 in FIG. 3 but with the cover closed to illustrate the orientation of the tether prior to the initial opening movement of the cover.
Figure 7:
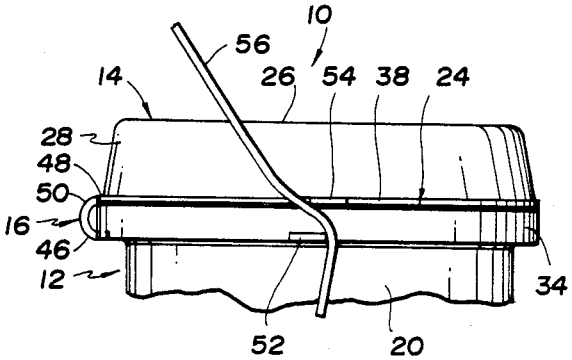
FIG. 7 is a partial elevation view of the container taken along the direction of line 7—7 in FIG. 6 and illustrates opening assist lugs on the receptacle and cover which are utilized in association with a pry in order to provide the intial unthreading movement of the cover for opening.

As illustrated in FIGS. 2, 6, and 7, the upper end 24 of the receptacle and the annular lip 28 of the cover are provided with associated opening assist lugs 52 and 54. These opening assist lugs 52 and 54 are positioned adjacent each other in the closed position of the cover as shown in FIG. 7 to permit a pry such as the curved end of a can opener 56 to be positioned between the lugs for the application of unthreading force to the cover. The force applied by the pry 56 may be used to fracture the tether 16 or such fracturing may be provided by cutting the tether with a knife or scissors as previously discussed. Usually, the fracture will be at the elongated intermediate portion 50 of the tether 16 as illustrated at 58 in FIG. 8. However, it is also possible for the fracture to be at one of the ends 46 or 48 of the tether 16. Upon the fracturing in whatever way and at whichever location, the tether 16 breaks to provide the visual indication that renders the container tamperproof.

While the best mode for carrying out the invention has been described in detail, those familiar with the art to which this invention relates will recognize various alternative designs and embodiments for practicing the invention as defined by the following claims.

What is claimed is:

1. A container comprising: a receptacle, a cover, and a tether that are molded from plastic unitary with each other with the receptacle and cover connected by the tether; said receptacle having a lower closed end and also having a round upper end that opens upwardly; the cover including an upper wall and an annular lip that extends downwardly from the upper wall; mating helical threads on the upper end of the receptacle and the annular lip of the cover; said threads having slide surfaces that are slidably engaged with each other by an initial downward movement of the cover over the receptacle; said threads also having locking surfaces that are engaged with each other by a snap action upon continued downward cover movement to secure the cover in a closed position on the receptacle and prevent upward opening movement thereof without unthreading rotation of the cover with respect to the receptacle; the tether having a length that is sufficiently long to permit the initial cover closing and sufficiently short to limit unthreading rotation of the closed cover in order to prevent opening thereof with the tether intact connecting the receptacle and the cover; and the tether being frangible to permit unthreading rotation of the cover for opening while also providing a visual indication of such opening to thereby render the container tamperproof.

2. A container as in claim 1 wherein the round upper end of the receptacle includes a retainer that prevents separating horizontal movement between the helical threads with the cover closed to thereby assist in the prevention of opening of the container cover with the tether intact.

3. A container as in claim 1 or 2 wherein the round upper end of the receptacle includes a seal, the cover having a seal surface that engages the receptacle seal with the cover closed to seal the container, and the cover including a retainer that engages the upper end of the receptacle adjacent the seal and prevents separating horizontal movement between the helical threads with the cover closed to thereby assist in the prevention of opening of the container cover with the tether intact.

4. A container as in claim 3 wherein the locking surfaces of the helical threads are inclined to secure the helical threads against separating movement in cooperation with the retainer securement.

5. A container as in claim 1 wherein the tether has an elongated shape including a first end integrally connected to the receptacle and a second end integrally connected to the cover.

6. A container as in claim 5 wherein the first end of the elongated tether is integrally connected to the upper end of the receptacle and the second end of the elongated tether is integrally connected to the annular lip of the cover.

7. A container as in claim 5 or 6 wherein the tether has a length that is short enough to require that the ends thereof be circumferentially aligned with respect to the container to permit the cover positioning over the receptacle for the downward closing movement with the tether intact, the helical threads on the upper end of the receptacle and the annular lip of the cover being positioned such that the cover during downward closing movement must be rotated in an unthreading direction with respect to the receptacle to provide the snap action engagement of the thread locking surfaces for securing the cover closed, and the extent of the cover unthreading movement during closing being of an extent that makes the tether taut to thereby prevent partial opening rotation of the cover with the tether intact.

8. A container as in claim 1, 2, 5, or 6 wherein the upper end of the receptacle and the annular lip of the cover include opening assist lugs that are positioned adjacent each other in the closed cover position and permit a pry to be utilized to rotate the cover in an unthreading direction with respect to the receptacle.

9. A container comprising: a receptacle, a cover, and a tether that are molded from plastic unitary with each other with the receptacle and cover connected by the tether; said receptacle having a lower closed end and also having a round upper end that opens upwardly; the cover including an upper wall and an annular lip that extends downwardly from the upper wall; mating helical threads on the upper end of the receptacle and the annular lip of the cover; said threads having slide surfaces that are slidably engaged with each other by an initial downward movement of the cover over the receptacle; said threads also having locking surfaces that are engaged with each other by a snap action upon continued downward cover movement to secure the cover in a closed position on the receptacle; the round upper end of the receptacle and the cover each having an associated retainer that cooperate to prevent separating horizontal movement between the helical threads with the cover closed to thereby prevent upward opening movement of the cover without unthreading rotation thereof with respect to the receptacle; the tether having a length that is sufficiently long to permit the initial cover closing and sufficiently short to limit unthreading rotation of the closed cover in order to prevent opening thereof with the tether intact connecting the receptacle and the cover; and the tether being frangible to permit unthreading rotation of the cover for opening while also providing a visual indication of such opening to thereby render the container tamperproof.

10. A container comprising: a receptacle, a cover, and a tether that are molded from plastic unitary with each other with the receptacle and cover connected by the tether; said receptacle having a lower closed end and also having a round upper end that opens upwardly; the cover including an upper wall and an annular lip that extends downwardly from the upper wall; mating helical threads on the upper end of the receptacle and the annular lip of the cover; said threads having slide surfaces that are slidably engaged with each other by an initial downward movement of the cover over the receptacle; said threads also having locking surfaces that are engaged with each other by a snap action upon continued downward cover movement to secure the cover in a closed position on the receptacle; the round upper end of the receptacle and the cover each having an associated retainer that cooperate to prevent separating horizontal movement between the helical threads with the cover closed to thereby prevent upward opening movement of the cover without unthreading rotation thereof with respect to the receptacle; the tether having an elongated shape including a first end integrally connected to the upper end of the receptacle and having a second end integrally connected to the annular lip of the cover; the tether having a length that is sufficiently long to permit the intial cover closing with the ends thereof circumferentially aligned with respect to the container; the helical threads on the upper end of the receptacle and the annular lip of the cover being positioned such that the cover during downward closing movement must be rotated in an unthreading direction with respect to the receptacle to provide the snap action engagement of the locking surfaces that secures the cover closed; the extent of the cover unthreading movement during closing being of an extent that makes the tether taut to thereby prevent partial opening rotation of the cover with the tether intact; and the tether being frangible to permit unthreading rotation of the cover for opening while also providing a visual indication of such opening to thereby render the container tamperproof.

* * * * *